United States Patent [19]

Quesnel

[11] 4,429,646

[45] Feb. 7, 1984

[54] METHOD AND APPARATUS FOR BURNING DAMP OIL-SHALES OF LOW HEATING POWER

[75] Inventor: Guy Quesnel, Gif sur Yvette, France

[73] Assignee: Societe anonyme dite: Stein Industrie, Velizy-Villacoublay, France

[21] Appl. No.: 389,350

[22] Filed: Jun. 17, 1982

[30] Foreign Application Priority Data

Dec. 11, 1981 [FR] France ..... 81 23182

[51] Int. Cl.[3] ..... F23D 1/00

[52] U.S. Cl. ..... 110/347; 110/224; 110/232

[58] Field of Search ..... 110/232, 224, 347, 204

[56] References Cited

U.S. PATENT DOCUMENTS 2,694,991 11/1954 Marquez, Jr. ..... 110/232
4,249,470 2/1981 Vatsky ..... 110/232

FOREIGN PATENT DOCUMENTS 1174935 7/1964 Fed. Rep. of Germany .
2853031 6/1980 Fed. Rep. of Germany .
869574 4/1958 United Kingdom .

*Primary Examiner*—Edward G. Favors
*Attorney, Agent, or Firm*—Sughrue, Mion, Zinn, Macpeak, and Seas

[57] ABSTRACT

The oil-shale is burned in a combustion chamber (24) having a chimney, and the method comprises:

providing a drying gas by mixing hot gas taken from the combustion chamber via a duct (4) with relatively cool gas taken from the chimney via a duct (5), the proportions of said gasses being adjusted as a function quantity of water in said damp shale;

crushing lumps of said shale in a crusher (6) and in the presence said drying gas;

injecting the resulting grains of crushed shale together with the hot gas into an expansion chamber (8) in which the major portion of the grains falls out from the drying gas, while the lightest portion of grains is entrained by the gas;

passing the drying gas together with said lightest portion of grains entrained thereby via a duct (9) through filter means (10) to separate said lightest portion of grains from the drying gas;

riddling said major portion of the grains (at 17A, 17B) to provide a larger grain fraction and a smaller grain fraction;

recycling said larger grain fraction via a duct (19) through said crusher;

combining said smaller grain fraction with the said lightest portion of grains separated by said filter means (at 21); and injecting the combined grains into said combustion chamber in a suspension in primary air (25A, 25B).

11 Claims, 1 Drawing Figure

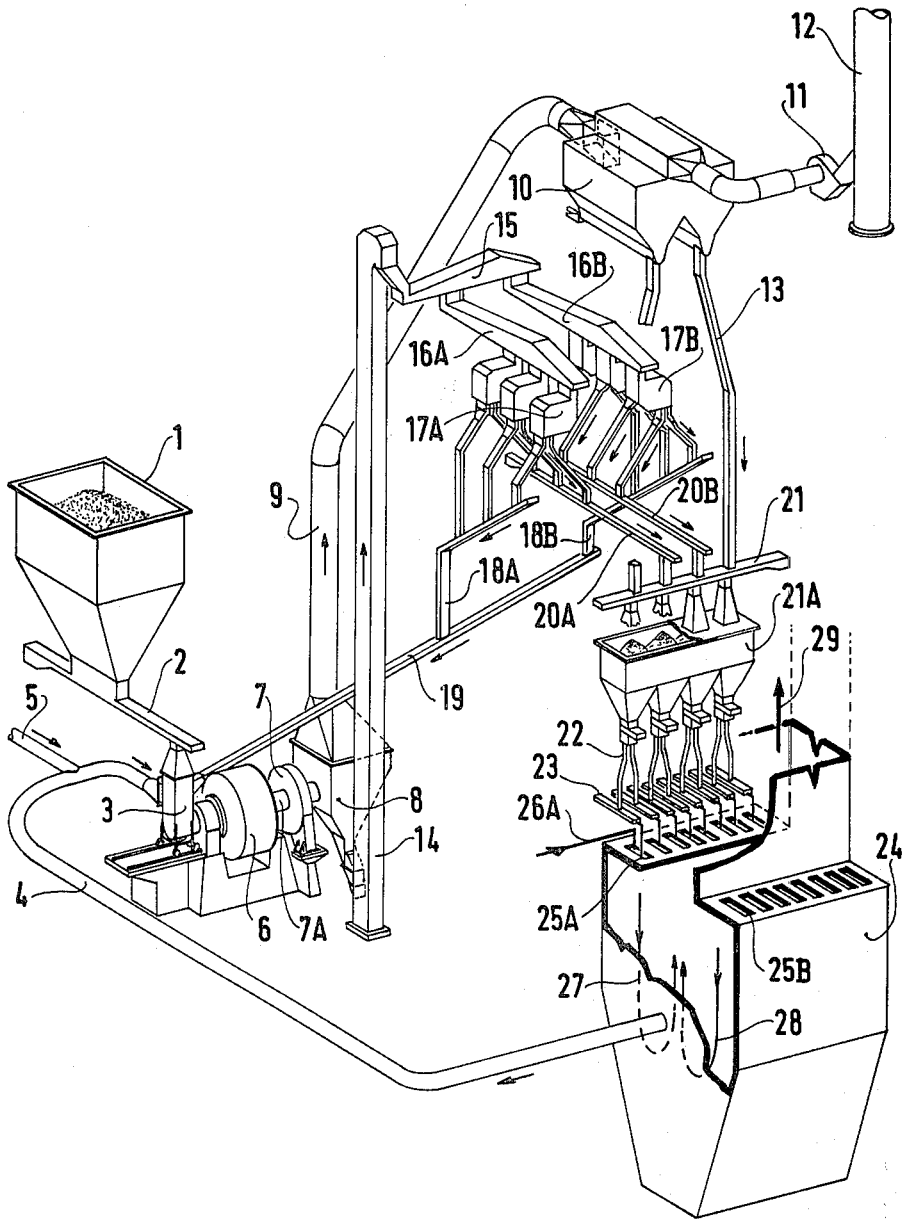
12
11
10
15
16B
13
16A
17B
17A
1
9
20B
21
18B
18A
20A
21A
29
2
5
7
19
22
23
3
8
26A
14
24
4
6
7A
25A
25B
27
28

METHOD AND APPARATUS FOR BURNING DAMP OIL-SHALES OF LOW HEATING POWER

The present invention relates to a method of burning damp oil-shales of low heating power in a combustion chamber. In particular, it relates to the kind of method in which the shale is crushed in the presence of a hot drying gas, and the resulting grains are riddled to separate out the largest grains for recycling, while the remainder are injected into the combustion chamber in a suspension in primary air.

The invention also relates to apparatus for performing the method.

BACKGROUND OF THE INVENTION

Oil-shales of this type contain carbonates and silicates and generally have properties roughly as follows:

Maximum heating power—1,000 Cal/kg

Organic matter—20% by weight

Ash—65% by weight

Water content—15% by weight

Oil-shales have already been burned in boilers having mechanical gratings. Such boilers are only acceptable for burning relatively low hourly tonages of fuel.

It might be thought that the techniques used for burning low quality coals or lignites could be transposed to burning such oil-shales. However, the high proportion of silica-rich, abrasive ash contained in such oil-shales would lead to the crushers consuming a large amount of energy and to excessive wear thereof.

Further, due to their low heating power, such oil-shales require large quantities of gas for drying and for transport after crushing. Air cannot used both for this purpose and for supplying the oxygen for combustion in the combustion chamber, since the resulting combustion would be incomplete and of poor quality.

Preferred implementations of the present invention remedy these difficulties by providing a method in which damp oil-shale is crushed without excessive consumption of energy nor excessive wear of the crusher, in which the smallest grains from the crusher are readily extracted for burning, and in which satisfactory combustion is obtained in the combustion chamber.

SUMMARY OF THE INVENTION

The present invention provides a method of burning damp oil-shale of low heating power in a combustion chamber having a chimney, the method comprising:

providing a drying gas by mixing hot gas taken from the combustion chamber with relatively cool gas taken from the chimney, the proportions of said gasses being adjusted as a function quantity of water in said damp shale;

crushing lumps of said shale in a crusher and in the presence said drying gas;

injecting the resulting grains of crushed shale together with the hot gas into an expansion chamber in which the major portion of the grains falls out from the drying gas, while the lightest portion of grains is entrained by the gas;

passing the drying gas together with said lightest portion of grains entrained thereby through filter means to separate said lightest portion of grains from the drying gas;

riddling said major portion of the grains to provide a larger grain fraction and a smaller grain fraction;

recycling said larger grain fraction through said crusher;

combining said smaller grain fraction with the said lightest portion of grains separated by said filter means; and injecting the combined grains into said combustion chamber in a suspension in primary air.

The method preferably includes at least one of the following features:

Crushing is obtained solely by attrition of the grains against one another;

Crushing is performed until the average grain size lies in the range 0.1 mm to 1 mm;

The riddling of said major portion of the grains ensures that the combustion chamber is fed with grains not exceeding 0.8 mm in size;

The crushed and riddled grains are suspended at high concentration in said primary air when injected into the combustion chamber, thereby enabling secondary air to be injected into the chamber at a high quantity relative to the quantity of primary air which is injected.

The present invention also provides apparatus for burning damp oil-shale of low heating power, wherein the apparatus comprises:

a combustion chamber having a chimney;

means for mixing hot gas taken from the combustion chamber with relatively cool gas taken from the chimney to provide a drying gas, the proportions of said gasses being adjusted as a function quantity of water in said damp shale;

a crusher for crushing lumps of said shale in the presence said drying gas;

an expansion chamber for receiving grains of crushed shale together with the hot gas from said crusher, the major portion of the grains falling out from the drying gas in said expansion chamber, while the lightest portion of grains is entrained by the gas;

means for conveying the drying gas together with said lightest portion of grains entrained thereby to filter means for separating said lightest portion of grains from the drying gas;

riddling means for riddling said major portion of the grains to provide a larger grain fraction and a smaller grain fraction;

means for recycling said larger grain fraction through said crusher;

means for combining said smaller grain fraction with the said lightest portion of grains separated by said filter means; and means for injecting the combined grains into said combustion chamber in a suspension in primary air.

The apparatus preferably includes at least one of the following features:

The crusher is an autogenous crusher;

The means for filtering said lightest portion of the grains comprises sleeve filters;

The riddling means is constituted by vibrating screens; and

The combustion chamber is a double arched hearth.

BRIEF DESCRIPTION OF THE DRAWING

An embodiment of the invention is described by way of example with reference to the accompanying drawing, in which the sole FIGURE is a partially cut away perspective diagram of apparatus for crushing, transporting and then burning damp oil-shales of low heating power using a method in accordance with the invention.

MORE DETAILED DESCRIPTION

Oil-shale for processing is delivered in the form of lumps averaging in size from 0 to 300 mm. Their heating power is greater than 1,000 Cal/kg, and by weight they comprise about 15% water, about 20% organic matter (of which 80% is volatile matter), and about 65% ash. The oil-shale is initially loaded into a supply hopper 1, from which a conveyor 2 delivers it to a supply box 3. The supply box 3 is supplied with hot drying gas constituted by a mixture of hot combustion gases bled from the hearth of the combustion chamber at about 900° C. via a duct 4, and smoke bled from the bottom of the boiler chimney at a temperature of about 160° C. via a duct 5. The proportions of these gasses are controlled to obtain a drying gas at a temperature of about 650° C. The lumps for processing and the drying gas are inserted together into a heavily armoured autogenous crusher 6 which is constituted by a relatively flat cylinder supported by two bearings and driven at about 12 to 20 rpm by a motor 7. In an autogneous crusher, the lumps crush one another by colliding. In the present crusher, they are dried at the same time. The roughly crushed product leaves via a hollow trunnion exit 7A to enter an expansion chamber 8. If the oil-shale is relatively hard, or if particularly small grains are required, balls may be added to the crusher 6, which should then be fed with small sized lumps (eg. 0 to 25 mm).

In the expansion chamber, the finest particles comprising grains of an average size of less than 100 microns, and constituting about 15% of the processed product, are entrained by the drying gas up a vertical duct 9 which leads to a set of sleeve filters 10, ie. filters having elongate tubular closed sleeves sacks or bags in which the particles are collected, as in a vacuum cleaner. These particles are stopped by the filters, while the drying gas is sucked on by a fan 11 and is rejected to the atmosphere via a pipe 12. The particles extracted by the filter are sent via ducts 13 to combustion chamber feed screens where they are mixed in with larger riddled grains as explained below.

The larger grains collect in the bottom of the expansion chamber 8 whence they are removed by the buckets of a bucket conveyor 14 and fed to a main manifold 15 which feeds subsidiary manifolds 16A and 16B whence the grains fall onto riddles 17A or 17B. These riddles are constituted by vibrating screens having holes that are 0.8 mm across. Grains too big to pass through this mesh are rejected via sloping ducts 18A and 18B leading to a common duct 19 for recycling via the crusher feed box 3.

Grains that pass through the 0.8 mm mesh are conveyed by transporters 20A and 20B and a distribution belt 21 to feed hoppers 21A for the combustion chamber. The fine particles removed by the filters 10 are also conveyed to the belt 21 via ducts 13.

The grains are transported at a measured rate from the hoppers 21A via ducts 22 to low gradient (10° to 15°) air cushion slides 23 which feed the burners. The grains are suspended in primary air in much the same manner as is already used for other granular fuels, but at the relatively high concentration of about 1 kg of oil-shale grains to 0.5 kg of air, thereby facilitating ignition.

They are then blown into a double arched combustion chamber 24. (The injection of the fuel into the combustion chamber is shown diagrammatically as taking place via orifices 25A.) Secondary air arrives via ducts 26A in the usual manner and is also blown into the burners around the grains suspended in the primary air. The primary air comprises about 40% of the total air blown in.

A second fuel supply unit (not shown) analogous to the fuel supply unit described above, feeds a second set of burners on the other side of the combustion chamber via orificies 25B.

In the combustion chamber 24, the flames follow a U-shaped trajectory 27 or 28 before rising (arrow 29) to heat tubes (not shown) through which the water for boiling circulates. The hot gas taken from the combustion chamber at about 900° C. is drawn off via the duct 4 from near the bottom of the flame U-shape. As described above it is mixed with smoke taken from the chimney via the duct 5 to constitute a drying gas of desired temperature.

The clinker is collected in the usual manner on a grating (not shown) located near the bottom of the combustion chamber, and it is then cooled and removed. Soot entrained by the combustion gasses is captured by natural or electrostatic filter means (not shown), and is also removed.

Although the apparatus described with reference to the drawing appears to be the best known manner of performing the invention, it is clear that various modifications could be made thereto without going outside the scope of the claims. In particular, the sleeve filters for recovering the dust due to crushing could be replaced by cyclone separators even though they are not so efficient. The gas charged with residual dust particles could then be re-injected into the combustion chamber, if required.

I claim:

1. A method of burning damp oil-shale of low heating power in a combustion chamber having a chimney, the method comprising:

providing a drying gas by mixing hot gas taken from the combustion chamber with relatively cool gas taken from the chimney, in proportions correlated to the quantity of water in said damp shale;

crushing lumps of said shale in a crusher and in the presence of said drying gas;

injecting the resulting grains of crushed shale together with the hot gas into an expansion chamber in which the major portion of the grains falls out from the drying gas, while the lightest portion of grains is entrained by the gas;

passing the drying gas together with said lightest portion of grains entrained thereby through filter means to separate said lightest portion of grains from the drying gas;

riddling said major portion of the grains to provide a larger grain fraction and a smaller grain fraction;

recycling said larger grain fraction through said crusher;

combining said smaller grain fraction with said lightest portion of grains separated by said filter means; and injecting the combined grains into said combustion chamber in a suspension in primary air.

2. A method according to claim 1, wherein crushing is obtained solely by attrition of the grains against one another.

3. A method according to claim 1, wherein crushing is performed until the average grain size lies in the range 0.1 mm to 1 mm.

4. A method according to claim 3, wherein the riddling of said major portion of the grains is conducted in a manner that ensures that the combustion chamber is fed with grains not exceeding 0.8 mm in size.

5. A method according to claim 1, wherein the crushed and riddled grains are suspended at high concentration in said primary air when injected into the combustion chamber, and said method further comprises injecting secondary air into the chamber at a high quantity relative to the quantity of primary air which is injected.

6. A method according to claim 1, wherein combustion is performed by making the grain charged gas follow a U-shaped trajectory during combustion.

7. Apparatus for burning damp oil-shale of low heating power, wherein the apparatus comprises:

a combustion chamber having a chimney;

means for mixing hot bas taken from the combustion chamber with relatively cool gas taken from the chimney to provide a drying gas;

a crusher for crushing lumps of said shale in the presence of said drying gas;

an expansion chamber for receiving grains of crushed shale together with the hot gas from said crusher, the major portion of the grains falling out from the drying gas in said expansion chamber, while the lightest portion of grains is entrained by the gas;

means for conveying the drying gas together with said lightest portion of grains entrained thereby to filter means for separating said lightest portion of grains from the drying gas;

riddling means for riddling said major portion of the grains to provide a larger grain fraction and a smaller grain fraction;

means for recycling said larger grain fraction through said crusher;

means for combining said smaller grain fraction with said lightest portion of grains separated by said filter means; and means for injecting the combined grains into said combustion chamber in a suspension in primary air.

8. Apparatus according to claim 7, wherein the crushing means comprises an autogenous crusher.

9. Apparatus according to claim 7, wherein the means for filtering said lightest portion of grains comprises sleeve filters.

10. Apparatus according to claim 7, wherein the riddling means is constituted by vibrating screens.

11. Apparatus according to claim 7, wherein the combustion chamber is a double arched hearth.

* * * * *